US007402088B2

(12) United States Patent
Hsu et al.

(10) Patent No.: US 7,402,088 B2
(45) Date of Patent: Jul. 22, 2008

(54) ELECTRICAL CONNECTOR WITH IMPROVED TERMINALS

(75) Inventors: Kuo-Chun Hsu, Tu-cheng (TW); Ti-Li Wei, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/890,861

(22) Filed: Aug. 8, 2007

(65) Prior Publication Data

US 2008/0038957 A1 Feb. 14, 2008

(51) Int. Cl.
*H01R 13/22* (2006.01)

(52) U.S. Cl. ..... 439/862; 439/495

(58) Field of Classification Search ..... 439/494, 439/495, 862

See application file for complete search history.

(56) References Cited

U.S. PATENT DOCUMENTS 5,024,605 A * 6/1991 Kasatani et al. ..... 439/500
6,004,156 A 12/1999 Roque et al.
6,120,328 A * 9/2000 Bricaud et al. ..... 439/630
6,319,076 B1 * 11/2001 Gollhofer et al. ..... 439/862
6,398,598 B2 * 6/2002 Masumoto ..... 439/862
6,616,485 B2 * 9/2003 Harasawa et al. ..... 439/630
2005/0020137 A1 1/2005 Tanaka et al.
2006/0110974 A1 * 5/2006 Suzuki et al. ..... 439/495

* cited by examiner

*Primary Examiner*—Tho D Ta
(74) *Attorney, Agent, or Firm*—Wei Te Chung

(57) ABSTRACT

An electrical connector for connecting a sheet-like connection member (6) with a plurality of conductive pads (60) thereon comprises an insulative housing (1) defining a receiving cavity (10), and a plurality of conductive terminals (2) arranged in the insulative housing. Each terminal is made by stamping a piece of metal plate and comprises a base section (20), a first resilient arm (21) extending aslant from the base section, an extending section extending forwards from the base section and a second resilient arm (23) extending aslant from said extending section. The first and the second resilient arms (21,23) of each terminal respectively has a contact portion (211,231) to electrically and mechanically contact with a corresponding same conductive pad (60) of said sheet-like connection member (6).

15 Claims, 6 Drawing Sheets

ELECTRICAL CONNECTOR WITH IMPROVED TERMINALS

BACKGROUND OF THE INVENTION

1. Field of the Invention

The present invention relates to an electrical connector, and more particular to a miniature electrical connector.

2. Description of Related Art

U.S. Pat. No. 6,004,156 discloses an electrical connector, which is used for a flexible printed circuit (FPC). The electrical connector includes an insulating housing having an upper wall, a lower wall and a receiving cavity between the upper and lower walls, a plurality of terminals received in the housing, and a pressing member mounted on the housing. Each terminal has a fixed arm retained in the lower wall and a resilient arm with a contact portion exposed to the receiving cavity and received in the upper wall. The FPC has a plurality of conductive pads at one end for electrically contacting with the contact portions of the terminals. When the FPC is inserted into the receiving cavity, the pressing member urges the FPC to move upward, thereby electrical connection is achieved between the conductive pads and the terminals.

However, the conductive pads of the FPC are prone to be oxidized or covered with dust or other unexpected material, the preferred electrical connections between the conductive pads and the contact portions are hardly achieved. Besides, the fixed arm and the resilient arm are retained in different walls of the housing and take up a large space between said walls, which is not advantaged for reducing the height of the connector. Therefore, a new design is required.

SUMMARY OF THE INVENTION

An object of the present invention is to provide a miniature electrical connector.

Another object of the present invention is to provide an electrical connector with low profile terminals.

In order to achieve above-mentioned objects, an electrical connector comprises an insulative housing defining a receiving cavity and a plurality of terminal grooves communicating with the receiving cavity; a plurality of conductive terminals retained in the terminal grooves, each terminal is made by a metal plate; each conductive terminal comprising a base section, a first resilient arm and an extending section extending forward from the base section, and a second resilient arm formed on said extending section, wherein each of the first and second resilient arms respectively having a contact portion projecting into the receiving cavity and a free distal end of each terminal retained in an opening defined in the housing in front of the terminal groove.

Other objects, advantages and novel features of the present invention will become more apparent from the following detailed description of the present embodiment when taken in conjunction with the accompanying drawings.

DETAILED DESCRIPTION OF THE INVENTION

Figure 1:
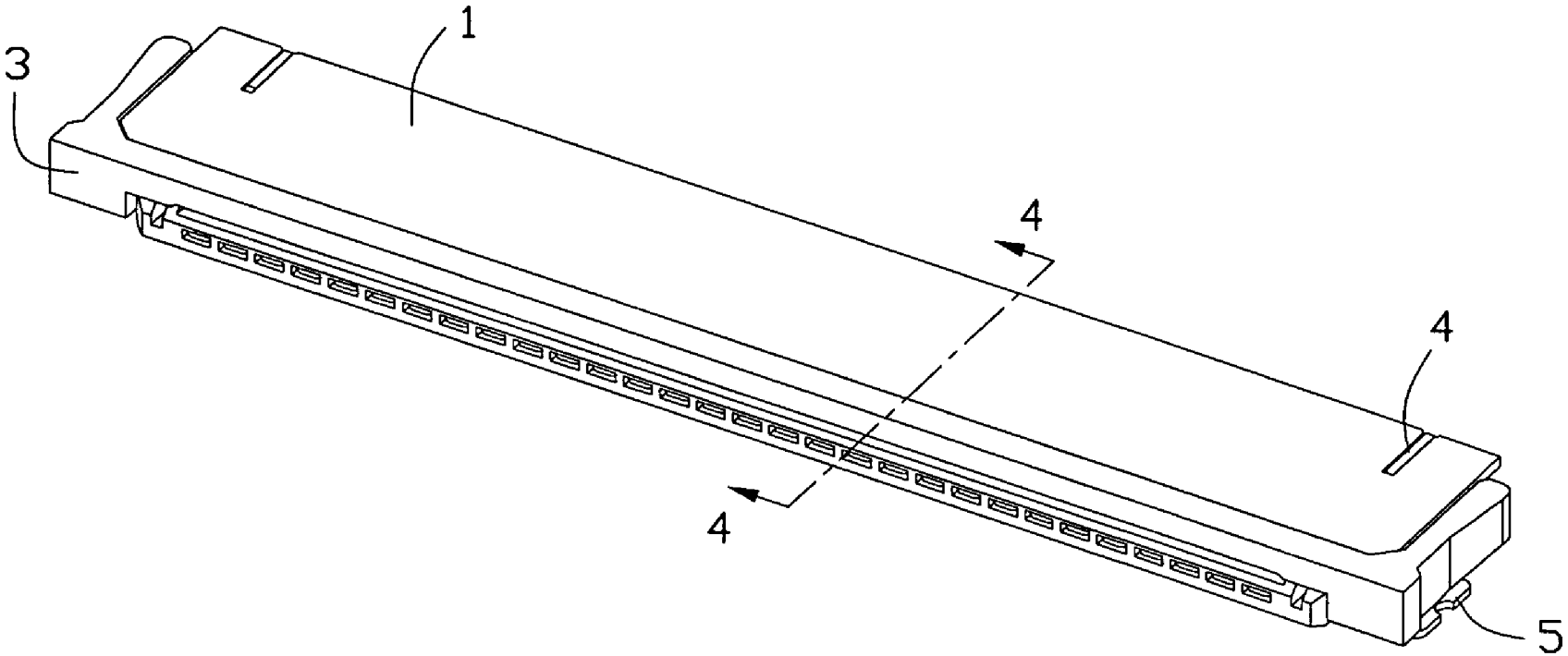
FIG. 1 is a perspective view of an electrical connector in accordance with the present invention.

Reference will now be made to the drawing figures to describe the preferred embodiment of the present invention in detail.

Figure 2:
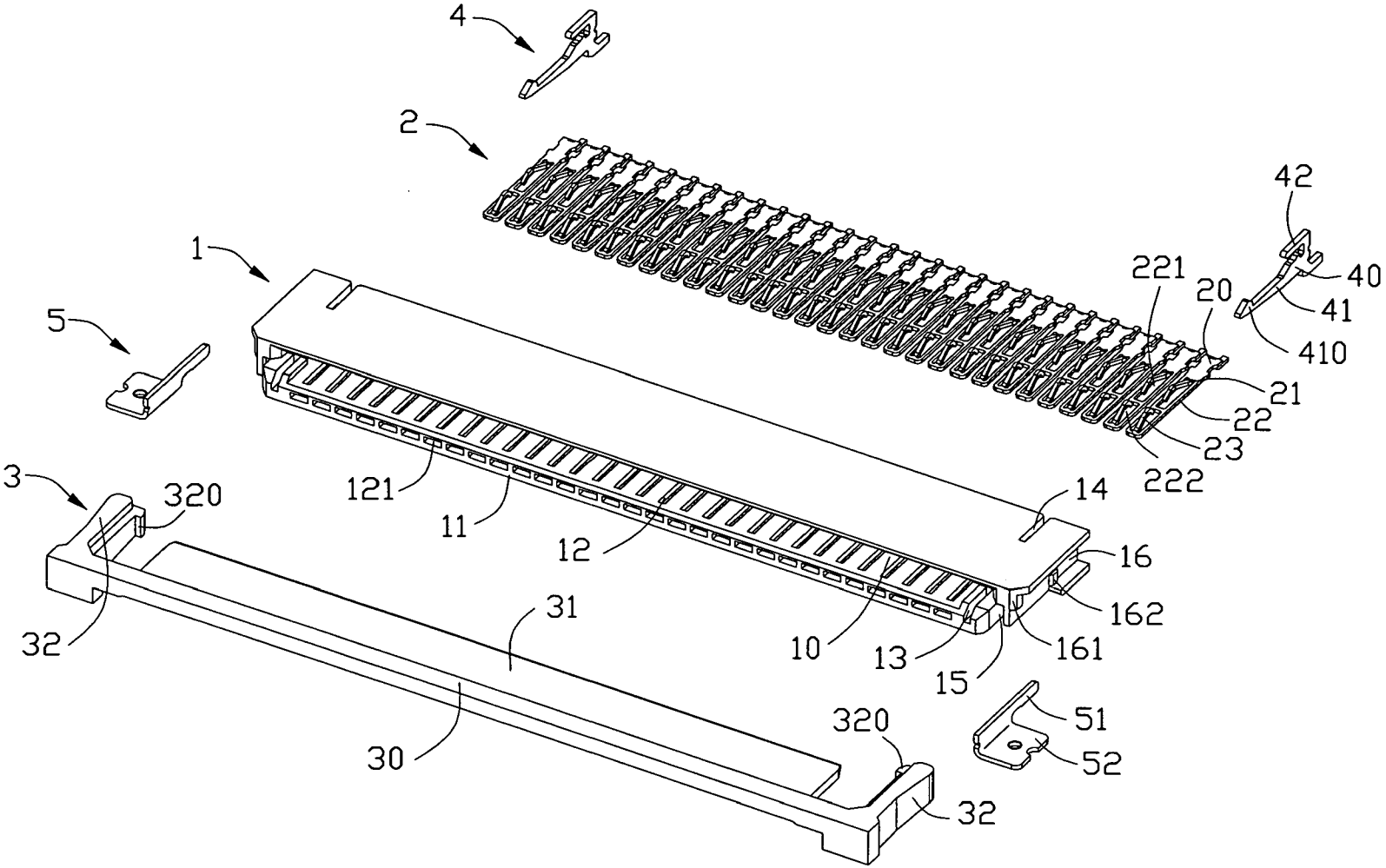
FIG. 2 is an exploded perspective view of the electrical connector.

Referring to FIGS. 1 and 2, an electrical connector comprises an insulative housing 1, a plurality of conductive terminals 2, a stuffer 3, a pair of retaining terminals 4 and a pair of holding components 5.

Figure 3:
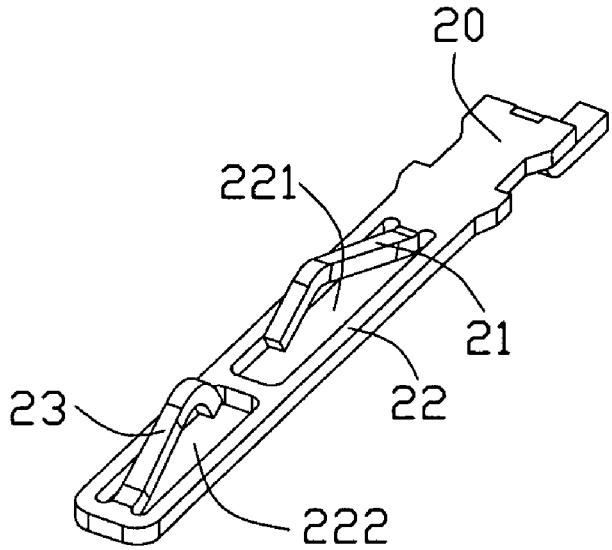
FIG. 3 is a perspective view of a terminal of the electrical connector.
Figure 4:
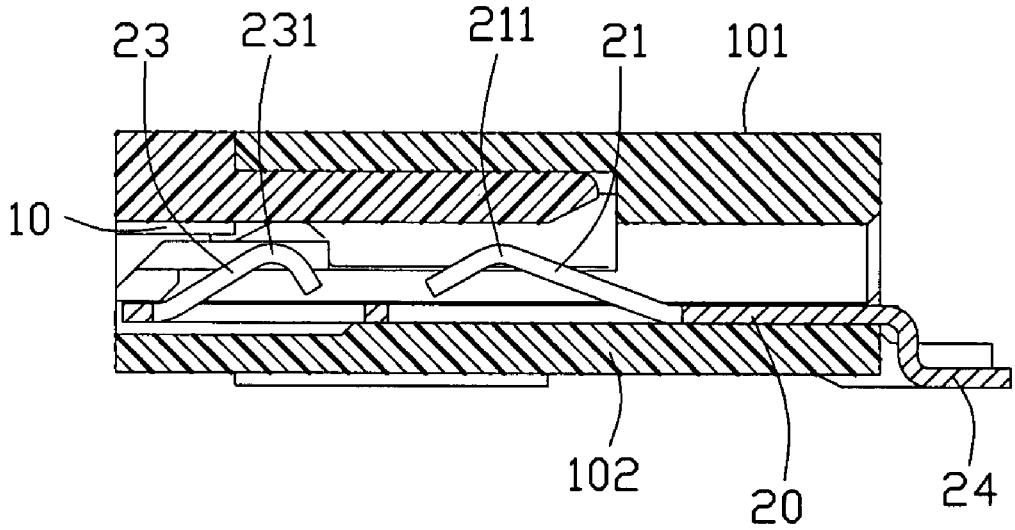
FIG. 4 is a cross-sectional view of the electrical connector taken along line 4-4 of FIG. 1.

As shown in FIGS. 3 and 4, each conductive terminal 2 comprises a base section 20, a solder tail 24 extending backwards from the base section 20, a first resilient arm 21 and an extending section extending forwards from the base section 20. In this embodiment, the extending section is a doorframe 22 with two windows, a first window 221 and a second window 222 apart from the base section 20. The first resilient arm 21 upwards slants above the first window 221 from the base portion. A second resilient arm 23 upwards slants above the second window 222 from the front end of the extending section apart from the base section. The first and second resilient arms are formed along a centric line of the terminal 2 and extending towards each other. Furthermore, the two resilient arms 21, 23 are bent downwards at the distal ends and respectively formed a contact potion 211, 231 nearly at the same height, as best shown in FIG. 4.

The housing 1 defines a receiving cavity 10 between an upper wall 101 and a lower wall 102. The lower wall 102 extends forward beyond the upper wall 101, referring to FIG. 2. A plurality of grooves 12 is formed in the lower wall along a front-to-back direction. The grooves 12 are communicating with the receiving cavity 10 and an opening 121 is formed at a front end of the lower wall. The conductive terminals 2 are inserted into the grooves 12 from the back of the insulative housing 1, with the distal ends of the terminals retained in the openings 121 and contact portions 211, 231 respectively projecting into the receiving cavity 10 to electrically and mechanically contact with the conductive pads of a flexible printed circuit (FPC) 6.

Figure 5:
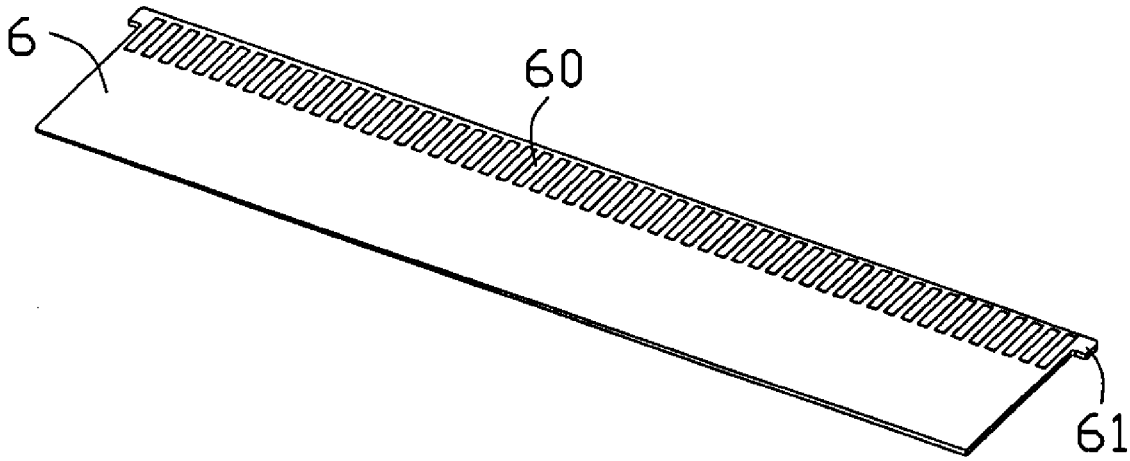
FIG. 5 is an FPC used for being inserted into the electrical connector.

Referring to FIG. 5, the FPC 6 comprises a plurality of conductive pads 60 arranged side by side in a row at its one end and a pair of projections 61 extending outward from lateral sides of the same end.

Referring to FIG. 2, the pair of retaining terminals 4 are respectively received in the slots 14 at two ends of the housing. Each retaining terminal 4 comprises a base portion 40, a fixing arm 42 and a retaining arm 41 longer than the fixing arm 42. The fixing arm 42 and the base section 40 are received in the housing and the retaining arm 41 extends along a groove 13 opposite the slot 14.

The pair of holding components 5 are used for mounting the connector to a circuit board (not shown). Each holding component 5 has an insertion portion 51, which is inserted in a channel 15 adjacent the groove 13 and retained in the housing, and a mounting portion 52, which is vertical to the insertion portion 51 and used to be soldered on the circuit board.

Furthermore, a guiding passageway 16 is defined at two ends of the housing. The guiding passageway 16 extends along the front-to-back direction through a rear end thereof. A first blocking portion 161 is at a front open of the passageway 16 and a second blocking portion 162 is in the middle of the passageway 16. The stuffer 3 has a rectangular base plate 30, a tongue plate 31 extending from the base plate 30 and a pair of latching arms 32 extending from lengthwise ends of the base plate 30 along a same direction of the tongue plate 31 to slide in the corresponding passageways 16. Each latching arm 32 has a latch 320 at its distal end, which faces to the tongue plate 31 for being blocked by the blocking portion 161,162 to prevent the stuffer 3 from breaking off the housing 1.

So, after the FPC 6 is inserted into the receiving cavity, push the stuffer 3 into the receiving cavity, the tongue plate 31 of the stuffer 3 urges the FPC 6 to move towards the contact portions 211, 231 so that the conductive pads 60 can electrically contact with the corresponding contact portions 211, 231 of the terminals 2. It is noted that the contact portion 211 and the contact portion 231 of one single terminal 2 electrically contact with the identical conductive pad 60 of the FPC. Therefore, the electric performance of the electrical connector is improved accordingly. Besides, the conductive terminal 2 is a kind of forming terminal, which is made by stamping a piece of metal plate and bending parts of it to form the resilient arms 21,23. As the two resilient arms are extending upwards from the same metal plate plane, and reach to the same height, therefore, the whole height of the connector can be reduced due to the low profile of the terminal 2, which is helpful to the miniaturization of the connector.

Figure 6:
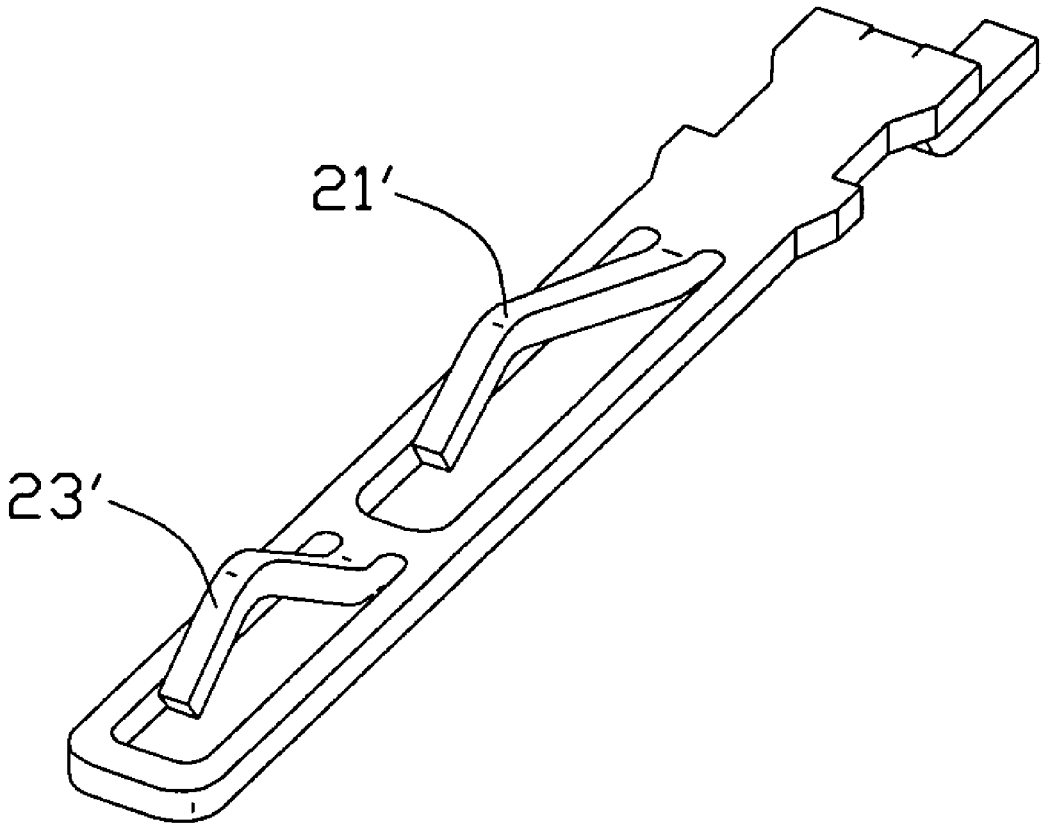
FIG. 6 is a perspective view of a terminal of the electrical connector in accordance with another embodiment of the invention.
Figure 7:
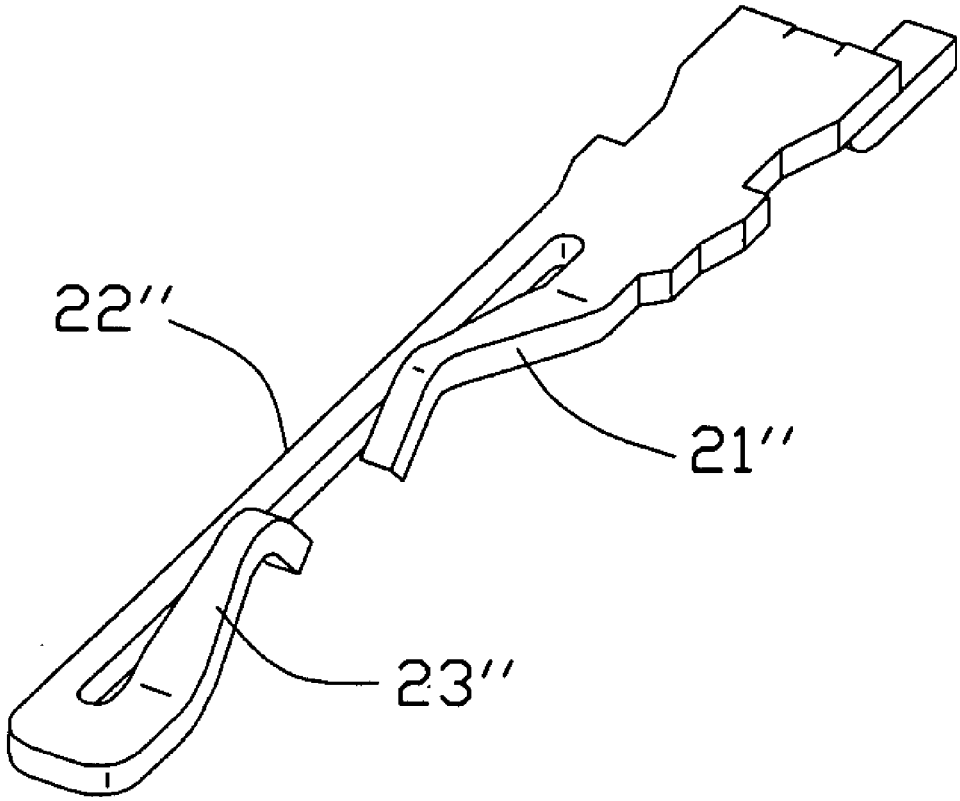
FIG. 7 is a perspective view of a terminal of the electrical connector in accordance with the other embodiment of the invention.

The present invention is not limited to the electrical connector mentioned above. This disclosure is illustrative only, changes may be made in detail, especially in matter of shapes, size, and arrangement of parts within the principles of the invention. For example, the followed two embodiments are also according with the present invention. As shown in FIG. 6, the first resilient arm 21' extends aslant the base portion, and the second resilient arm 23' extends along the same extending direction from the front window at the side near the base portion. Besides, as shown in FIG. 7, the terminal 2 has a single connecting arm 22" to replace the doorframe 22, and the second resilient arm 23" is formed in its distal end.

What is claimed is:

1. An electrical connector for connecting a FPC (Flexible Printed Circuit) with a plurality of conductive pads thereon comprising:

an insulative housing defining a receiving cavity;

a plurality of conductive terminals arranged in the insulative housing, and each terminal is made by stamping a piece of metal plate;

each conductive terminal comprising a base section, a first resilient arm extending aslant from the base section, an extending section extending forwards from the base section and a second resilient arm extending aslant from said extending section, wherein the first and the second resilient arms of each terminal respectively having a contact portion to electrically and mechanically contacting with a corresponding same conductive pad of said FPC (Flexible Printed Circuit).

2. The electrical connector as described in claim 1, wherein the base section and the extending section is in the metal plate plane, and the first and second resilient arms are beyond the metal plate plane.

3. The electrical connector as described in claim 1, wherein said second resilient arm extends from one end of said extending section, and the first and second resilient arms extend toward each other.

4. The electrical connector as described in claim 3, wherein said extending section is a single connecting arm and the second resilient arm extends from a distal end of the connecting arm.

5. The electrical connector as described in claim 3, wherein said extending section is a doorframe extending from the base section, and the second resilient arm extends from one end of the doorframe apart from the base section.

6. The electrical connector as described in claim 5, wherein said doorframe comprises two windows.

7. The electrical connector as described in claim 1, wherein said second resilient arm extends from the extending section along a same extending direction of the first resilient arm.

8. The electrical connector as described in claim 7, wherein said extending section is a doorframe with two windows, the second resilient arm extends from one end of the front window near the base portion.

9. An electrical connector comprising:

an insulative housing defining a receiving cavity for receiving a FPC (Flexible Printed Circuit) and a plurality of terminal grooves communicating with the receiving cavity;

a plurality of conductive terminals retained in the terminal grooves;

each conductive terminal comprising a base section, a first resilient arm and an extending section extending forwards from the base section, and a second resilient arm formed on said extending section, wherein each of the first and the second resilient arms having a contact portion projecting into the receiving cavity and a free distal end of each terminal retained in an opening defined in the housing in front of the terminal groove.

10. The electrical connector as described in claim 9, wherein each terminal is made by a piece of metal plate, the base section and extending section are in the metal plate plane, and said first and second resilient arms are extending beyond the meztal plate plane.

11. The electrical connector as described in claim 10, wherein said first and second resilient arms are formed along a centric line of the conductive terminal.

12. An electrical connector assembly comprising:

an insulative housing defining a receiving cavity and a plurality of terminals communicating with the receiving cavity;

a plurality of conductive terminals retained in the terminal grooves, each terminal is made by a piece of metal plate;

each conductive terminal comprising a horizontal base, a first resilient arm and a second resilient arm extending from said base, wherein the first and the second resilient arms respectively have contact portions projecting above the base under a condition that the contact portion of the first resilient arm and the contact portion of the second resilient arm are aligned with each other along a front-to-back direction;

wherein a FPC (Flexible Printed Circuit) inserted into the receiving cavity and forming thereon a plurality of pads each mechanically and electrically engaged with the contact portions of both the first resilient arm and the second resilient arm of each corresponding conductive terminal.

13. The electrical connector assembly as claimed in claim 12, wherein each of said first resilient arm and said second resilient arm extends from an interior edge of a confined opening in said base.

14. The electrical connector assembly as claimed in claim 12, wherein said first resilient arm and said second resilient arm extend along a same direction.

15. The electrical connector assembly as claimed in claim 12, wherein said first resilient arm and said second resilient arm extend along opposite directions.

* * * * *